US009982442B2

(12) United States Patent
Kufner et al.

(10) Patent No.: US 9,982,442 B2
(45) **Date of Patent: *May 29, 2018**

(54) TILE ALIGNMENT AND LEVELING DEVICE

(71) Applicant: Davinci Italia/USA Group, LLC, Fairfield, IA (US)

(72) Inventors: Edward A Kufner, Fairfield, IA (US); Ralph Burgin, West Point, IA (US)

(73) Assignee: Davinci Italia/USA Group, LLC, Fairfield, IA (US)

( * ) Notice: Subject to any disclaimer, the term of this patent is extended or adjusted under 35 U.S.C. 154(b) by 5 days.

This patent is subject to a terminal disclaimer.

(21) Appl. No.: 14/957,997

(22) Filed: Dec. 3, 2015

(65) Prior Publication Data

US 2016/0108627 A1 Apr. 21, 2016

Related U.S. Application Data

(63) Continuation of application No. 13/848,862, filed on Mar. 22, 2013, now Pat. No. 9,228,363.

(60) Provisional application No. 61/614,993, filed on Mar. 23, 2012.

(51) Int. Cl.
*E04F 21/20* (2006.01)
*E04F 21/00* (2006.01)

(52) U.S. Cl.
CPC ..... *E04F 21/20* (2013.01); *E04F 21/0092* (2013.01)

(58) Field of Classification Search
CPC ..... E04F 21/18; E04F 21/00; E04F 21/20
USPC ..... 33/526, 527
See application file for complete search history.

(56) References Cited

U.S. PATENT DOCUMENTS

| | | | |
|---|---|---|---|
| 1,817,447 | A | 8/1931 | Simpson |
| 3,301,121 | A | 1/1967 | Newcomer |
| 3,511,001 | A | 5/1970 | Morgan |
| 3,537,146 | A | 11/1970 | Caveney |
| 4,286,497 | A | 9/1981 | Shamah |
| 4,397,124 | A | 8/1983 | Redman |
| 4,397,125 | A | 8/1983 | Gussler |
| 4,503,654 | A | 3/1985 | Constenino |
| 4,558,544 | A | 12/1985 | Albrecht |

(Continued)

FOREIGN PATENT DOCUMENTS

| | | |
|---|---|---|
| BE | 815222 | 9/1974 |
| FR | 2328811 | 5/1977 |
| GB | 2460429 | 2/2009 |

OTHER PUBLICATIONS

Southwest Equipment Management, Inc. TILE EZE, Marble-Plane promotional literature.

(Continued)

*Primary Examiner* — Yaritza Guadalupe-McCall
(74) *Attorney, Agent, or Firm* — Nyemaster Goode, PC

(57) ABSTRACT

A device for aligning and leveling tiles as they are laid in floors, walls, countertops, or the like. The device has a locking assembly and a bottom plate combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries. The locking assembly has flexible members adapted to exert a constant compressive force against the tiles during the tile leveling process.

16 Claims, 7 Drawing Sheets

(56) References Cited

U.S. PATENT DOCUMENTS

| | | | |
|---|---|---|---|
| 4,809,477 | A | 3/1989 | Gasser |
| 4,865,501 | A | 9/1989 | Ferris |
| 4,897,899 | A | 2/1990 | Shely |
| 5,000,890 | A | 3/1991 | Distefano |
| 5,209,621 | A | 5/1993 | Burbidge |
| 5,212,920 | A | 5/1993 | Tye |
| 5,263,260 | A | 11/1993 | Smith |
| 5,288,534 | A | 2/1994 | Tavshanjian |
| 5,568,785 | A | 10/1996 | Hazen |
| 5,584,452 | A | 12/1996 | Koike |
| 5,601,261 | A | 2/1997 | Koike |
| 5,603,195 | A | 2/1997 | Constenino |
| 5,607,256 | A | 3/1997 | McCleary |
| 5,674,942 | A | 10/1997 | Hill |
| 5,675,942 | A | 10/1997 | Crawford |
| 5,702,218 | A | 12/1997 | Onofrio |
| 5,832,619 | A | 11/1998 | Volkema |
| 5,875,606 | A | 3/1999 | Jensen |
| 5,966,781 | A | 10/1999 | Geiger |
| 6,000,184 | A | 12/1999 | Fernandes |
| 6,347,435 | B1 | 2/2002 | Davignon |
| 6,412,185 | B1 | 7/2002 | Mills |
| 6,578,239 | B2 | 6/2003 | Hatch |
| 6,625,951 | B1 | 9/2003 | McCarthy |
| 6,658,703 | B1 | 12/2003 | Teagno |
| 6,704,972 | B2 | 3/2004 | Pyle |
| 7,001,126 | B2 | 2/2006 | Lesecq |
| 7,257,926 | B1 | 8/2007 | Kirby |
| 7,520,030 | B2 | 4/2009 | Laporte |
| 7,621,100 | B2 | 11/2009 | Kufner |
| 7,861,487 | B2 | 1/2011 | Kufner |
| 7,945,300 | B2 | 6/2011 | Kufner |
| 7,954,300 | B1 | 6/2011 | Kufner |
| 8,079,199 | B1 | 12/2011 | Kufner |
| 8,099,926 | B2 | 1/2012 | Kufner |
| D658,963 | S * | 5/2012 | Kufner ..... D8/105 |
| 8,181,420 | B2 * | 5/2012 | Torrents I Comas ..... E04F 21/0092 52/127.7 |
| 8,336,279 | B2 | 12/2012 | Kufner |
| 8,635,815 | B2 | 1/2014 | Bordin |
| 8,966,835 | B1 | 3/2015 | Hoffman |
| 2002/0157339 | A1 | 10/2002 | Repasky |
| 2002/0187020 | A1 | 12/2002 | Julien |
| 2003/0177613 | A1 | 9/2003 | Caveney |
| 2006/0185269 | A1 | 8/2006 | Kufner |
| 2006/0185319 | A1 | 8/2006 | Kufner |
| 2007/0266531 | A1 | 12/2007 | Krisel |
| 2008/0236094 | A1 | 10/2008 | Doda |
| 2010/0263304 | A1 | 10/2010 | Torrents |
| 2014/0283401 | A1 | 9/2014 | Kufner |
| 2016/0108627 | A1 * | 4/2016 | Kufner ..... E04F 21/0092 52/126.1 |

OTHER PUBLICATIONS

European Search Report EP 11000098, Gert Stevens, dated May 31, 2011.

* cited by examiner

TILE ALIGNMENT AND LEVELING DEVICE

This application is a continuation of U.S. patent application Ser. No. 13/848,862 filed Mar. 22, 2013, which is based upon U.S. Provisional Application Ser. No. 61/614,993 filed Mar. 23, 2012, the complete disclosures of which are hereby expressly incorporated by this reference.

BACKGROUND

This invention is directed to the field of laying and leveling tile and slabs. More particularly, the invention is directed to a device for aligning and leveling adjacent tiles as they are laid in floors, walls, countertops, or the like.

Tile has become a popular decorative and functional article for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip and fall on unevenly laid tiles. "Lippage" occurs when the edge of one tile is higher than the adjacent tile to a degree where someone could trip. Replacing or otherwise correcting errors in tile installation (such as lippage or improper tile alignment) takes time that adds to the total cost of the tile installation.

Laying and leveling tile can be difficult because many substrates are uneven, such as the ground when laying tile for an outdoor patio. In this case, it can be difficult to raise the low areas of the substrate with mortar or other objects so that all the tiles are level. Further, tiles can shift and sink into mortar as the mortar dries. It has traditionally been necessary to continually monitor newly laid tiles as the mortar dries to ensure that the tiles remain level. Tile installers have used a variety of devices and methods to maintain quality tile installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles an appropriate distance. This type of frame is typically a fixed grid which is designed for a specific tile size. One disadvantage of this type of device is that it is a fixed size which requires a professional installer to carry multiple frames in order to be capable of installing various tile sizes. A further disadvantage of this type of frame is that it is only capable of installing one type of tile at a time.

Another device used to lay and align adjacent tiles is a spacer such as the one described in U.S. Pat. No. 6,625,951 (McCarthy). These types of spacers typically provides a square edge for properly aligning adjacent tiles at right angles, and a height adjustment means for adjusting the height of the tiles relative to the mortar surface. One problem with these types of devices is the difficulty of setting multiple spacers to the same height which often results in an uneven tile surface. A related problem with these types of devices is that the adjustment means does not allow the height of the tiles to be adjusted after the tile is laid because the height adjustment means is located under the tile after the tile is laid.

Another problem occurs even when a tile leveling system is used during an installation. As the mortar cures or dries there tends to be shrinkage, which can cause the tile leveling system being employed to loosen, which could result in lippage.

Therefore, there is a need for an efficient and inexpensive tile leveling and alignment device that allows for the vertical alignment of tiles relative to each other after the tiles have been laid in the mortar.

SUMMARY

The present invention is directed to a tile leveling and alignment device for use in installing tiles on substrates such as floors, walls, countertops, or the like. The invention comprises a locking assembly and a bottom plate combined with a shaft that extends from the bottom plate through the locking assembly so that the locking assembly is movable along the length of the shaft. A typical first step in laying tile is the application of a setting bed, such as a cement or mortar compound, to the substrate surface. Thereafter, the tiles can be placed in the setting bed. During these steps the bottom plate is positioned in the setting bed beneath the tiles so that the shaft extends upward between adjacent tiles. The bottom plate is preferably positioned so that it is in contact with more than one tile. The shaft extends from the bottom plate upward between adjacent tiles and is combined with the locking assembly. The locking assembly is movably combined with the shaft so that after the tiles are laid in the setting bed on top of the bottom plate, the locking assembly is moved toward the tiles until the tiles are between and in contact with the locking assembly and bottom plate. The locking assembly applies a constant force while the curing mortar is shrinking to help ensure the tiles relative to each other do not shift.

After the setting bed dries, thereby securing the tiles to the substrate, the shaft is separated from the bottom plate leaving the bottom plate beneath the tiles. Thereafter, the locking assembly can be reused in subsequent tile setting and leveling procedures.

One of ordinary skill in the art would understand that a plurality of tile leveling devices can be simultaneously used between different tiles being laid on a substrate so as to level many tiles at the same time.

DETAILED DESCRIPTION

The present invention is a tile alignment and leveling device. The device can be used to align and level tiles 18, 18*a* that are being secured to any suitable substrate, including floors, walls, and countertops. It should be noted that words used in this specification such as upper, lower, top, and bottom, are relative to the device as it is shown in FIG. 1 with the locking assembly 10 above the bottom plate 12.

Figure 1:
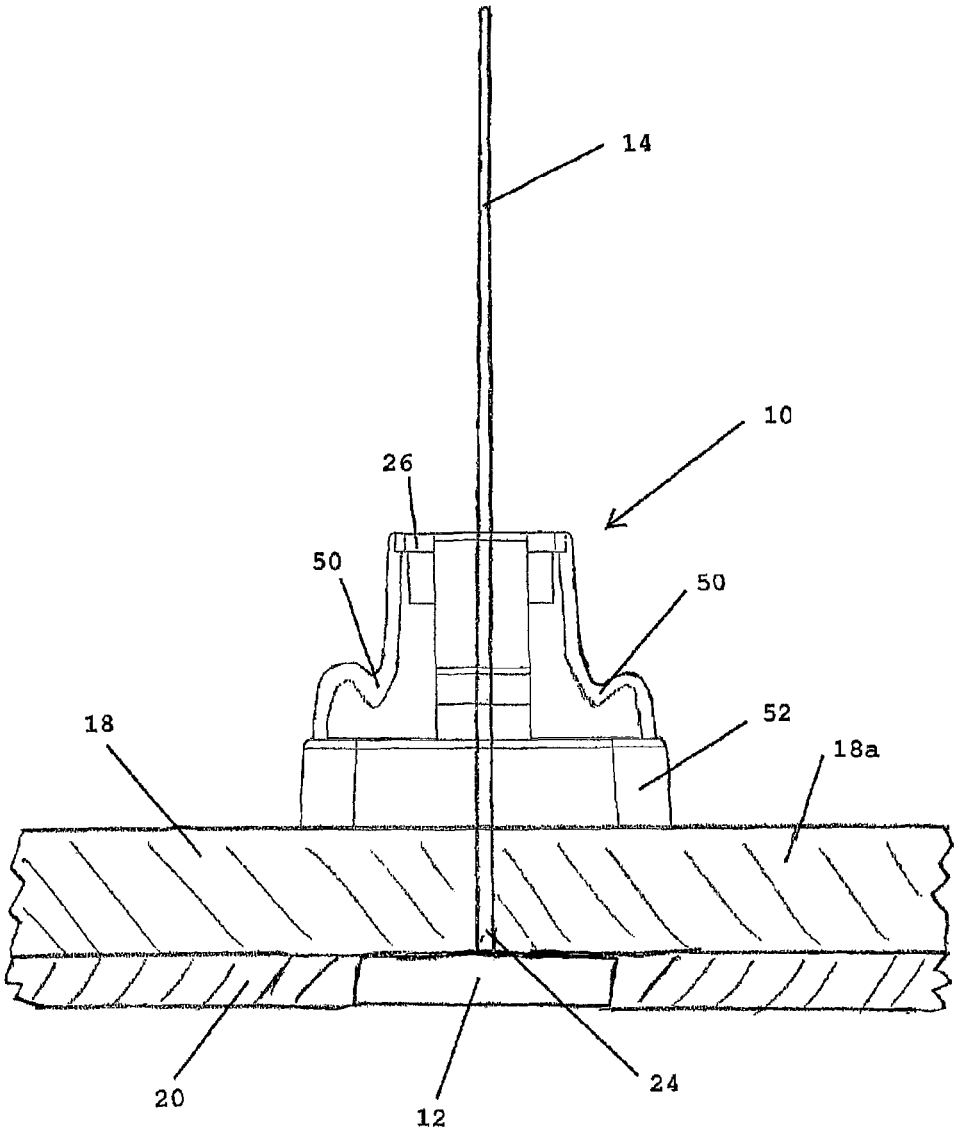
FIG. 1 is a side view of the device being used between adjacent tiles showing the flexible members in their compressed position.

As best seen in FIG. 1, the present invention comprises a locking assembly 10 and a bottom plate 12 combined with a shaft 14. The plate 12 can be made from any suitable material including metal, however, it is preferably comprised of a thermoplastic polymer such as nylon. The shaft 14 and locking assembly 10 are preferably comprised primarily of flexible thermoplastic polymers such as nylon, polyoxymethylene (DELRIN), or polypropylene thereby making them semi-rigid.

A typical first step in laying tile 18 is to apply a setting bed 20 such as mortar or cement to the substrate surface. After the setting bed 20 is applied, the tiles 18, 18*a* can be placed in the setting bed 20. In use, the bottom plate 12 is positioned in the setting bed 20 beneath the tiles 18 so that the shaft 14 extends upward between adjacent tiles 18, 18*a*, preferably at a joint or on the edge or corner locations. The shaft 14 extends from the bottom plate 12 upward between the tiles 18, 18*a* and is combined with the locking assembly 10, which is positioned above the tiles 18, 18*a*. Once the tiles 18, 18*a* are properly positioned, the locking assembly 10 is moved down the shaft 14 toward the tiles 18, 18*a* until the top surface of the tiles 18, 18*a* are in contact with the locking assembly 10 and the bottom surface of the tiles 18, 18*a* are in contact with the bottom plate 12 as shown in FIG. 1. The locking assembly 10 is prevented from moving upward along the shaft 14 by a securing mechanism. The plate 12 and locking assembly 10 hold the tiles 18, 18*a* at their desired height so that adjacent tiles 18, 18*a* are level regardless of whether the underlying substrate material is level. In other words, the bottom plate 12 does not need to rest on the substrate in order for the tiles 18, 18*a* to be level. The bottom plate 12 may even be suspended above the substrate as long as the tiles 18, 18*a* are level relative to each other. The plate 12 and locking assembly 10 hold the tiles 18, 18*a* at the same height so that corners and/or edges of the adjacent tiles 18, 18*a* remain aligned and level as the setting bed 20 hardens.

In some embodiments the securing mechanism is a locking pawl 22 combined with the locking assembly 10 adapted to interfere with a plurality of teeth on the shaft 14. The locking pawl 22 interferes with the teeth to allow the locking assembly 10 to move in a first direction down the shaft (toward the bottom plate 12) but prevent the locking assembly 10 from moving in a second (opposite) direction. In some embodiments the locking pawl 22 comprises a release mechanism that may be manually activated by the user to release the interference between the pawl 22 and the teeth thereby allowing movement of the locking assembly 10 in the second (upward) direction. In some embodiments the pawl 22 may be on the shaft 14 and the teeth on the locking assembly 10. In another embodiment, the securing mechanism comprises one or more upwardly angled locking tongues combined with the locking assembly 10 which are adapted to dig into or penetrate the surface of the shaft 14 to prevent movement of the locking assembly 10 in the second (upward) direction. Other securing mechanisms may be used to prevent the locking assembly 10 from moving upward after it has been secured in place.

Figure 2:
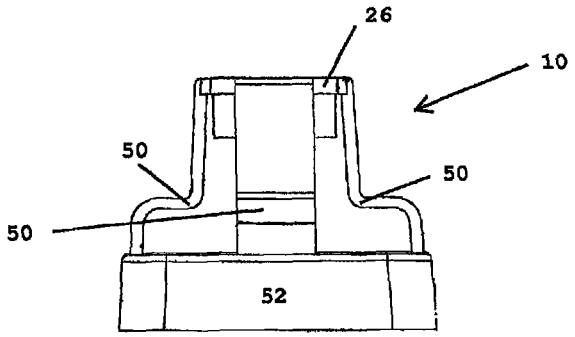
FIG. 2 is a side view of the locking assembly with its flexible members in their retracted position.
Figure 3:
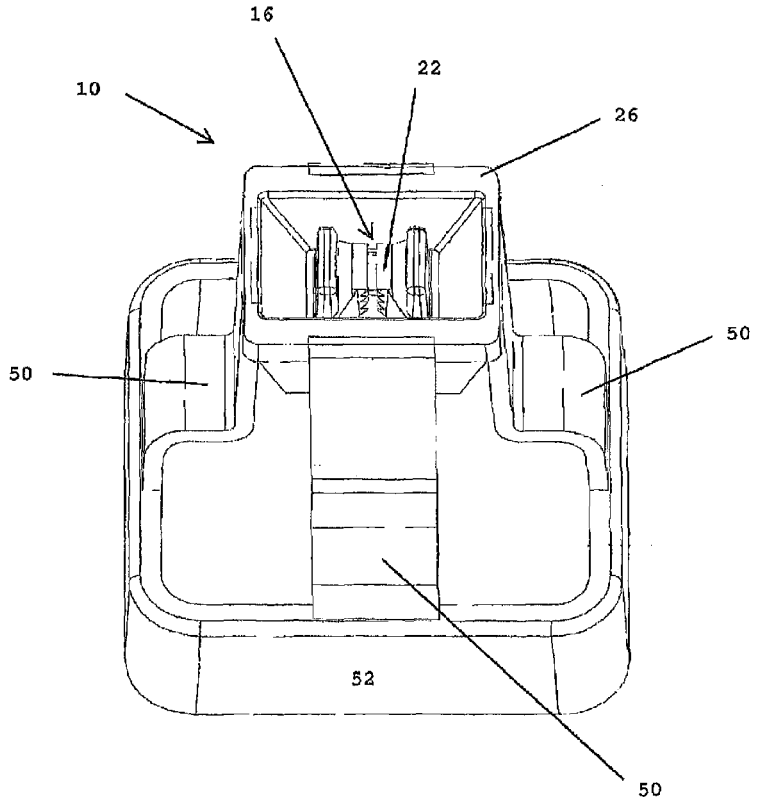
FIG. 3 is a perspective view an embodiment of the locking assembly showing the latching pawls.
Figure 4:
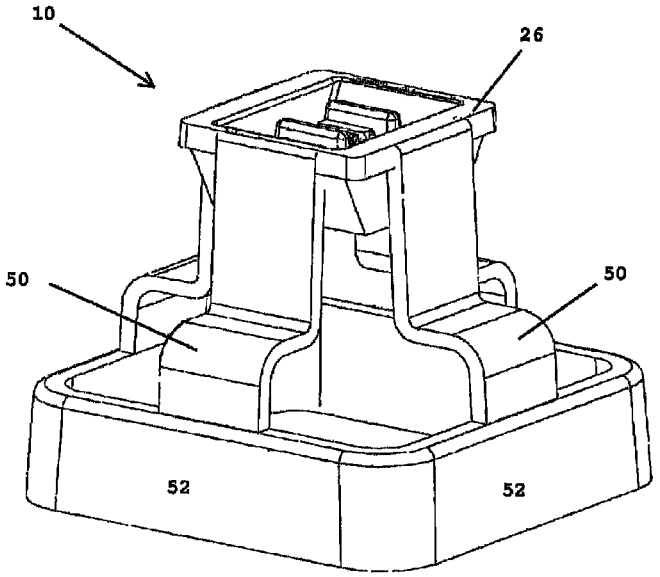
FIG. 4 is a perspective view of an embodiment of the locking assembly.
Figure 5:
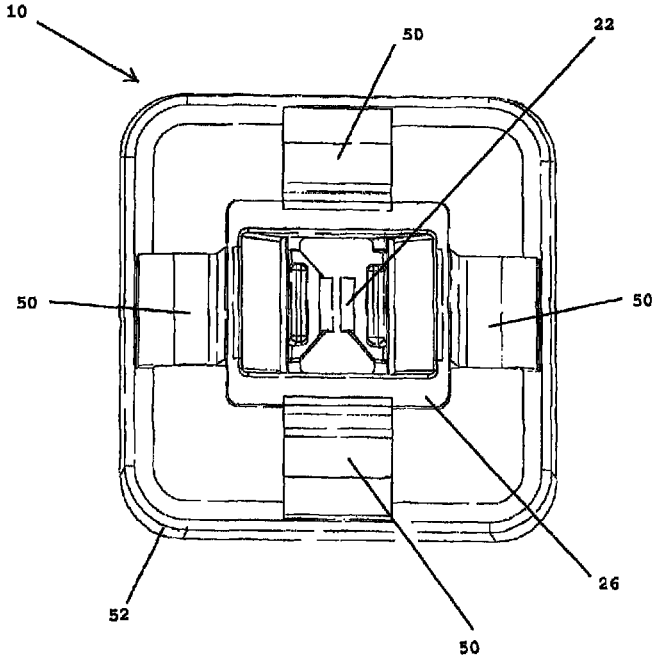
FIG. 5 is a top view of an embodiment of the locking assembly.

The locking assembly 10 comprises a first portion 26 and a second portion 52. The first portion 26 is adapted to receive the shaft 14 through an opening 16 and engage the shaft as described below. The second portion 52 is adapted to engage the tiles 18, 18*a*. As shown in FIG. 1, the locking assembly 10 comprises one or more flexible members 50 connecting the locking assembly 10 first portion 26 to the locking assembly 10 second portion 52. The flexible members 50 are comprised of a material that has a flexible or spring-like quality, such as a thermoplastic polymer such as nylon or polyoxymethylene (DELRIN). In some embodiments metal may be used. The flexible members 50 are adapted to move between a compressed position (FIGS. 1 and 7) and a retracted or resting position (FIGS. 2 and 4). The flexible members 50 are biased in their retracted position. As described above, the user moves the locking assembly 10 down the shaft until the locking assembly second portion 52 contacts the tiles 18, 18*a*. Then, the user forces the locking assembly first portion 26 down the shaft 14 even farther as the second portion 52 remains stationary against the tiles 18, 18*a* thereby causing the flexible members 50 to move from their retracted position to their compressed position. The locking pawl 22 (or other securing mechanism) holds the locking a assembly 10 in place relative to the shaft 14 thereby retaining the locking members 50 in their compressed position. In their compressed position the flexible members 50 exert force against the second portion 52 as the flexible members 50 try to return to their retracted state, which in turn exerts force against the tiles 18, 18*a*. The force of the locking assembly 10 against the tiles 18, 18*a* helps to ensure that the tiles 18, 18*a* remain level even if shifting or shrinking occur during the curing of the setting bed 20.

Figure 6:
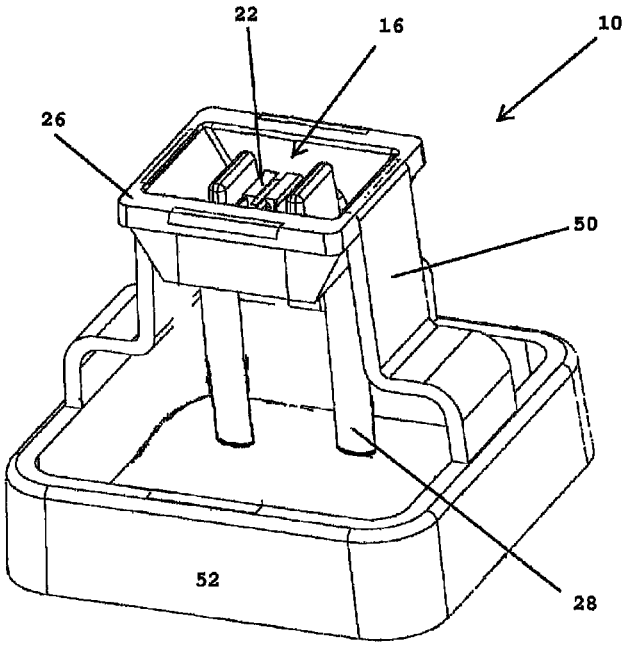
FIG. 6 is a perspective view of an embodiment of the locking assembly showing the posts.

FIG. 6 shows an embodiment having vertical stops 28 such as one or more elongated post members extending downward from the locking assembly 10 first portion 26. The stops 28 extend downward from the first portion 26 but are not long enough to reach the horizontal plane created by the bottom of the second portion 52 when the locking assembly is in its retracted position. As the first portion 26 of the locking assembly is compressed toward the second portion 52, the stops 28 move downward with the first portion 26 toward the tile 18, 18*a*. The stops 28 are adapted to contact the tile 18, 18*a* after the first portion 26 has moved downward a predetermined distance to prevent the first portion 26 from moving too far relative to the second portion 52 which could damage the flexible members 50.

In some embodiments, the bottom plate 12 comprises one or more openings. The openings allow the setting bed material 20 to seep through the bottom plate 12 to bond with the portion of the tile 18 above the bottom plate 12, which otherwise may not contact much of the setting bed material 20. Further, the seepage helps to ensure that the tiles 18 remain level as forces are applied to the plate 12, setting bed material 20, and/or tiles 18 during tightening, leveling, and setting. If the setting bed material 20 was not allowed to seep through the bottom plate 12, the setting bed material 20 could raise the bottom plate 12 as it dried which would consequently affect the level of the tiles 18, 18*a*.

After the setting bed 20 dries, and the tiles 18 are secured to the substrate 22, the user removes the portion of the device that is visible above the laid tiles 18, 18*a*, i.e. the shaft 14 and locking assembly 10. In one embodiment, the shaft 14 comprises a separation point 24 near the connection of the shaft 14 and the bottom plate 12 as seen in FIG. 1. The separation point 24 is structurally weaker than the remainder of the shaft 14 so that the user can apply force to the portion of the shaft 14 that extends above the tiles 18 and cause the shaft 14 to break at its separation point 24. In some embodiments the separation point 24 comprises a single opening which allows the separation point 24 to be structurally weaker and separate when the proper force is applied by the user. In other embodiments the separation point 24 comprises a plurality of micro holes or perforations which allow the separation point 24 to be structurally weaker and separate when the proper force is applied by the user. In one embodiment, the curing process of the setting bed 20 pulls moisture out of the shaft 14 making it more brittle. This makes it easier for the user to break the shaft 14 at the separation point 24. Once separated at the separation point 24, the bottom plate 12 remains below the tiles 18 and is therefore not reusable. The locking assembly 10, however, can be removed from the shaft 14 and reused in subsequent tile laying operations. As discussed above, the shaft 14 is preferably made of a semi-rigid nylon. This semi-rigid material allow the shaft 14 to more easily be broken at its separation point 24.

In some embodiments, some or all of the shaft 14 is made of a soft plastic or an elastic material that allows the shaft 14 to stretch longitudinally when force is applied. In use, the locking assembly 10 can be positioned against the tile 18 so that the shaft 14 is stretched thereby causing the locking assembly 10 and the tile 18 to be forced together by the resiliency of the shaft 14. At the same time, an upward force would be exerted on the tile 18 by the flexible portion 50 thereby helping to secure and hold the tiles 18, 18*a* in their proper position.

Figure 7:
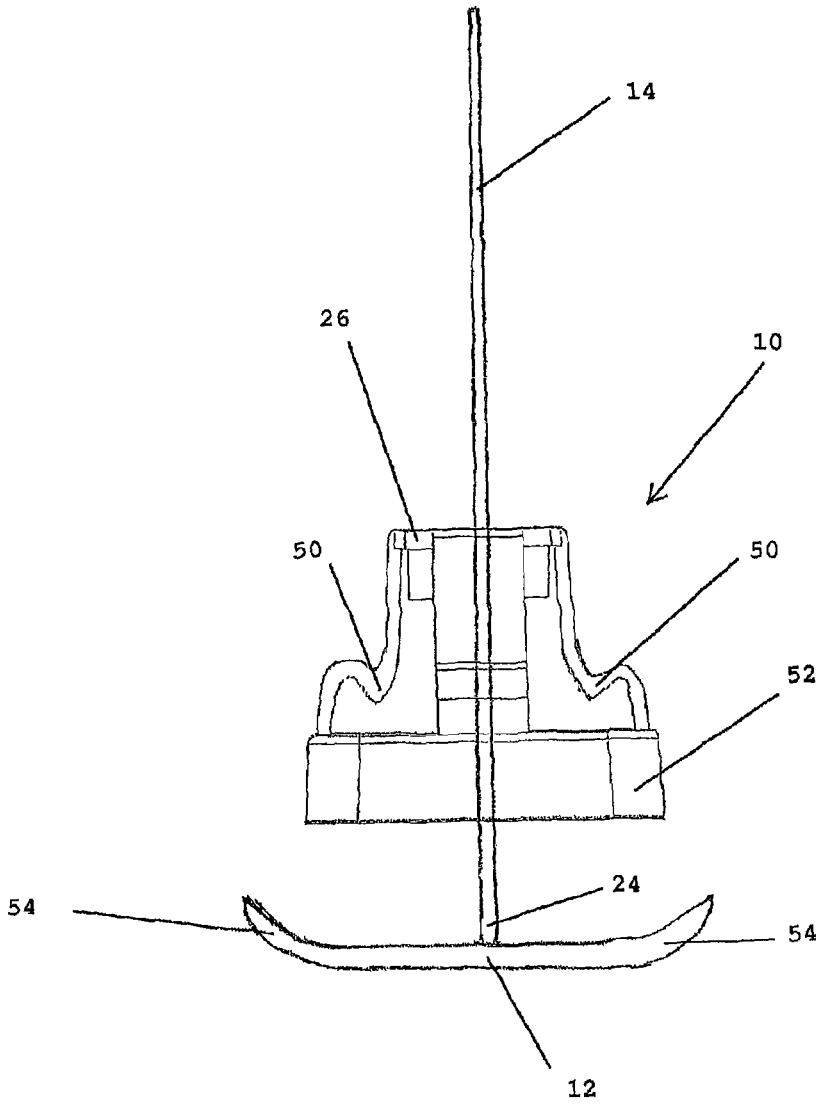
FIG. 7 is a side view of an embodiment wherein the bottom plate has flexible members.

FIG. 7 shows an embodiment wherein at least a portion of the bottom plate 12 is comprised of a material that has a flexible or spring-like quality similar to the types of materials that may be used for the flexible members 50. The flexible portion 54 of the bottom plate 12 is movable between a compressed position and a retracted position. The flexible portion 54 of the bottom plate 12 is biased in its retracted position wherein the flexible portion 54 extends upward toward the locking assembly 10. Weight from the tiles 18, 18*a* or force applied from above causes the flexible portion 54 to move to its compressed position. In its compressed position, the flexible portion 54 exerts upward force on the tiles 18, 18*a* as it tries to return to its retracted position. In some embodiments, the bottom plate 12 comprises two flexible portions 50 to allow the device to be used at the intersection of two tiles 18, 18*a* and in other embodiments the bottom plate 12 comprises four flexible portions 50 to allow the device to be used at the intersection of four tiles 18, 18*a*. In the embodiment shown in FIG. 7, each flexible portion 54 begins near the center of the bottom plate 12 and extends upward and outward therefrom. In other embodiments the flexible portion 54 begins near the outer ends of the bottom plate 12 and extends upward and inward. As shown in FIG. 7, the flexible portion 54 of the bottom plate 12 may be tapered so that it is thinner at its outer end to allow the device to be easily inserted under tiles 18, 18*a*.

In using the embodiment shown in FIG. 7, after the locking assembly 10 is secured in place, the flexible members 50 of the locking assembly 10 exert downward force against the top of the tiles 18, 18*a* while the flexible portion 54 of the bottom plate 12 exerts upward force against the bottom of the tiles 18, 18*a*. The opposing forces work to help ensure the tiles 18, 18*a* are firmly held between the locking assembly 10 and bottom plate 12 to help ensure an even surface.

The embodiment shown in FIG. 7 is also useful in situations where adjacent tiles 18, 18*a* have different thicknesses. The flexible portion 54 of the bottom plate 12 can be compressed under the weight of the thicker (heavier) tile 18, while the flexible or spring-like quality of the bottom plate 12 can remain in its retracted position under the thinner (lighter) tile 18*a* thereby holding the two adjacent tiles 18, 18*a* at the same elevation. In this manner, the tile alignment and leveling device is self-adjusting after it has been placed under the tiles 18, 18*a*.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A device for laying and leveling tiles, said device comprising:

a locking assembly adapted to be slidably combined with a shaft, wherein the locking assembly has a first portion with an opening adapted to receive the shaft, a second portion adapted to engage the tiles, and a flexible member combined with the first portion on one end and the second portion on another end, wherein the flexible member is movable between a compressed position and a retraced position such that the flexible member moves from its retracted position to its compressed position when the first portion is moved closer to the second portion, said flexible member is biased in its retracted position; and a securing mechanism which allows the locking assembly to move in a first direction along the shaft but not in a second direction along the shaft.

2. A device for laying and leveling tiles, said device comprising:

a bottom plate having a top surface;

a shaft combined with and extending upwardly from the top surface of the bottom plate;

a locking assembly having a first portion with an opening adapted to receive the shaft, a second portion adapted to engage the tiles, and a flexible member combined with the first portion on one end and the second portion on another end, wherein the flexible member is movable between a compressed position and a retraced position such that the flexible member moves from its retracted position to its compressed position when the first portion is moved closer to the second portion, said flexible member is biased in its retracted position; and a securing mechanism which allows the locking assembly to move in a first direction along the shaft but not in a second direction along the shaft.

3. The device of claim 2 wherein the securing mechanism is a locking pawl assembly.

4. The device of claim 2 wherein the shaft further comprises an outer surface and the securing mechanism comprises a locking tongue combined with the locking assembly, said securing mechanism having an engaged position wherein the locking tongue pierces the outer surface of the shaft and a disengaged position wherein the locking tongue does not pierce the shaft, in its engaged position the locking tongue allows the locking assembly to move in a first direction along the shaft but not in a second direction along the shaft.

5. The device of claim 2 further comprising at least one stop member combined with the locking assembly first portion to limit the distance the flexible member can be compressed.

6. The device of claim 2 wherein the shaft further comprises a separation point having a plurality of micro holes that make it structurally weaker than the remainder of the shaft to allow the shaft to be separated from the bottom plate.

7. The device of claim 2 wherein the shaft is resilient thereby allowing it to stretch longitudinally along its length from a first position to a second position, said shaft being biased in its first position.

8. The device of claim 2 wherein the flexible member is made from polyoxymethylene (DELRIN).

9. A device for laying and leveling tiles, said device comprising:

a bottom plate having a top surface and a flexible portion that extends upwardly above the top surface of the bottom plate and is movable between a compressed position and a retracted position, said flexible portion being biased in its retracted position;

a shaft combined with and extending upwardly from the top surface of the bottom plate;

a locking assembly having a first portion with an opening adapted to receive the shaft, a second portion adapted to engage the tiles, and a flexible member combined with the first portion on one end and the second portion on another end, wherein the flexible member is movable between a compressed position and a retraced position and is biased in its retracted position; and a securing mechanism which allows the locking assembly to move in a first direction along the shaft but not in a second direction along the shaft.

10. The device of claim 9 wherein the flexible portion of the bottom plate begins near the center of the bottom plate and extends outward away from the shaft.

11. The device of claim 9 wherein the securing mechanism is a locking pawl assembly.

12. The device of claim 9 wherein the shaft further comprises an outer surface and the securing mechanism comprises a locking tongue combined with the locking assembly, said securing mechanism having an engaged position wherein the locking tongue pierces the outer surface of the shaft and a disengaged position wherein the locking tongue does not pierce the shaft, in its engaged position the locking tongue allows the locking assembly to move in a first direction along the shaft but not in a second direction along the shaft.

13. The device of claim 9 further comprising at least one stop member combined with the locking assembly first portion to limit the distance the flexible member can be compressed.

14. The device of claim 9 wherein the shaft further comprises a separation point having a plurality of micro holes that make it structurally weaker than the remainder of the shaft to allow the shaft to be separated from the bottom plate.

15. The device of claim 9 wherein the shaft is resilient thereby allowing it to stretch longitudinally along its length from a first position to a second position, said shaft being biased in its first position.

16. The device of claim 9 wherein the flexible member is made from polyoxymethylene (DELRIN).

* * * * *